US010427208B2

(12) United States Patent
Perry et al.

(10) Patent No.: US 10,427,208 B2
(45) Date of Patent: Oct. 1, 2019

(54) WIRE BENDER

(71) Applicant: Pensa Labs Inc., Brooklyn, NY (US)

(72) Inventors: Marco Perry, Brooklyn, NY (US); Mark Prommel, Brooklyn, NY (US); Chad Ingerick, Brooklyn, NY (US); Pil Ho Chung, Jersey City, NJ (US); Avi Bajpai, Brooklyn, NY (US); Thomas Mattimore, New York, NY (US)

(73) Assignee: Pensa Labs, Inc., Brooklyn, NY (US)

( * ) Notice: Subject to any disclaimer, the term of this patent is extended or adjusted under 35 U.S.C. 154(b) by 260 days.

(21) Appl. No.: 15/513,957

(22) PCT Filed: Sep. 30, 2015

(86) PCT No.: PCT/US2015/053197
§ 371 (c)(1),
(2) Date: Mar. 23, 2017

(87) PCT Pub. No.: WO2016/054189
PCT Pub. Date: Apr. 7, 2016

(65) Prior Publication Data

US 2017/0274442 A1 Sep. 28, 2017

Related U.S. Application Data

(60) Provisional application No. 62/057,935, filed on Sep. 30, 2014.

(51) Int. Cl.
*B21F 1/00* (2006.01)
*B21F 23/00* (2006.01)

(52) U.S. Cl.
CPC ..... *B21F 1/00* (2013.01); *B21F 23/00* (2013.01)

(58) Field of Classification Search
CPC ..... B21F 23/00; B21F 23/002; B21F 23/005; B21F 1/00; B21F 7/00; B21F 1/006; B21D 7/022
See application file for complete search history.

(56) References Cited

U.S. PATENT DOCUMENTS 3,245,433 A 4/1966 Taylor
3,680,347 A * 8/1972 Schenck ..... B21D 7/024 72/217

(Continued)

OTHER PUBLICATIONS

Pensa Labs, "DIWire, Now on Kickstarter," YouTube, Dec. 6, 2013, [video online], [retrieved on Nov. 23, 2015], Retrieved from the Internet: URL:http://www.youtube.com/watch?v=0jG4SWcThBc.

(Continued)

*Primary Examiner* — Teresa M Ekiert
(74) *Attorney, Agent, or Firm* — DLA Piper LLP (US)

(57) ABSTRACT

A wire bending device that includes a housing have a top plate, wherein the top plate includes a curved slot, a first pair of opposing wheels positioned over the top plate for feeding wire, and a bend head. The bend head includes an aperture configured to pass the wire fed from the first pair of opposing wheels, and first and second bend surfaces positioned adjacent to the curved slot and the aperture. A cam member that includes sloping cam surfaces, and a rotating pulley, both positioned under the top plate and configured to cause a first pin to rise up and travel along the curved slot for engaging with and bending wire against the first bend surface, and to cause a second pin to rise up and travel along the curved slot for engaging with and bending wire against the second bend surface.

12 Claims, 14 Drawing Sheets

(56) References Cited

U.S. PATENT DOCUMENTS

| | | | | |
|---|---|---|---|---|
| 4,091,845 | A | 5/1978 | Johnson | |
| 4,798,073 | A * | 1/1989 | Dischler | B21D 7/022 72/217 |
| 5,088,310 | A | 2/1992 | Anagnostopoulu | |
| 5,203,192 | A * | 4/1993 | Kimura | B21D 11/12 72/21.3 |
| 5,809,824 | A | 9/1998 | Hiltzman et al. | |
| 7,188,504 | B2 * | 3/2007 | Latour | B21D 7/022 72/217 |
| 8,333,097 | B1 * | 12/2012 | Frear | B21D 7/022 72/216 |
| 2014/0130567 | A1 | 5/2014 | Christofillis et al. | |

OTHER PUBLICATIONS

Pensa Labs, "DIWire Bender," YouTube, May 2, 2012, [video online], Retrieved from the Internet: https://www.youtube.com/watch?v=ve1zzDXlJoA.

* cited by examiner

WIRE BENDER

RELATED APPLICATIONS

This application claims the benefit of U.S. Provisional Application No. 62/057,935, filed on Sep. 30, 2014 and PCT Patent Application No. US2015/053197 filed on Sep. 30, 2015, which are incorporated herein by reference.

FIELD OF THE INVENTION

The present invention relates to devices that bend wire into desired shapes.

BACKGROUND OF THE INVENTION

Wire benders are devices that bend wire into desired 2-dimensional or 3-dimensional shapes. Early wire benders provided a mechanism that allowed a user to manually bend wire into desired shapes. See for example U.S. Pat. Nos. 4,091,845 and 5,809,824. More recently, motorized wire benders have been developed that use a moving pin under motor control to bend wire, some even operating under computer control. See for example U.S. Pat. No. 5,088,310. Drawbacks of such devices, however, include excessive expense, complexity and size. Additionally, such devices are difficult to set up and operate for each desired wire shape.

There is a need for a wire bender device design that is simple and relatively inexpensive and easy to operate, so that wire shapes can be effectively and efficiently created.

BRIEF SUMMARY OF THE INVENTION

The aforementioned problems and needs are addressed by a wire bending device that includes a housing have a top plate, wherein the top plate includes a curved slot, a first pair of opposing wheels positioned over the top plate for feeding wire, and a bend head. The bend head includes an aperture configured to pass the wire fed from the first pair of opposing wheels, and first and second bend surfaces positioned adjacent to the curved slot and the aperture. A cam member is disposed below the top plate, wherein the cam member includes a first vertically sloping cam surface, and a second vertically sloping cam surface. A rotatable pulley is disposed between the cam member and the top plate, and includes first and second holes. A first pin has a first end slidably engaged with the first cam surface, a middle portion extending through the first hole, and a second end. A second pin has a first end slidably engaged with the second cam surface, a middle portion extending through the second hole, and a second end. A motor is configured to rotate the pulley in opposing first and second rotational directions. The pulley rotating in the first rotational direction causes the first pin first end to slide along the first cam surface so that the first pin second end rises vertically through the curved slot and then travels along the curved slot for engaging with and bending the wire passing through the aperture against the first bend surface. The pulley rotating in the second rotational direction causes the second pin first end to slide along the second cam surface so that second pin second end rises vertically through the curved slot and then travels along the curved slot for engaging with and bending the wire passing through the aperture against the second bend surface.

Other objects and features of the present invention will become apparent by a review of the specification, claims and appended figures.

DETAILED DESCRIPTION OF THE INVENTION

Figure 1:
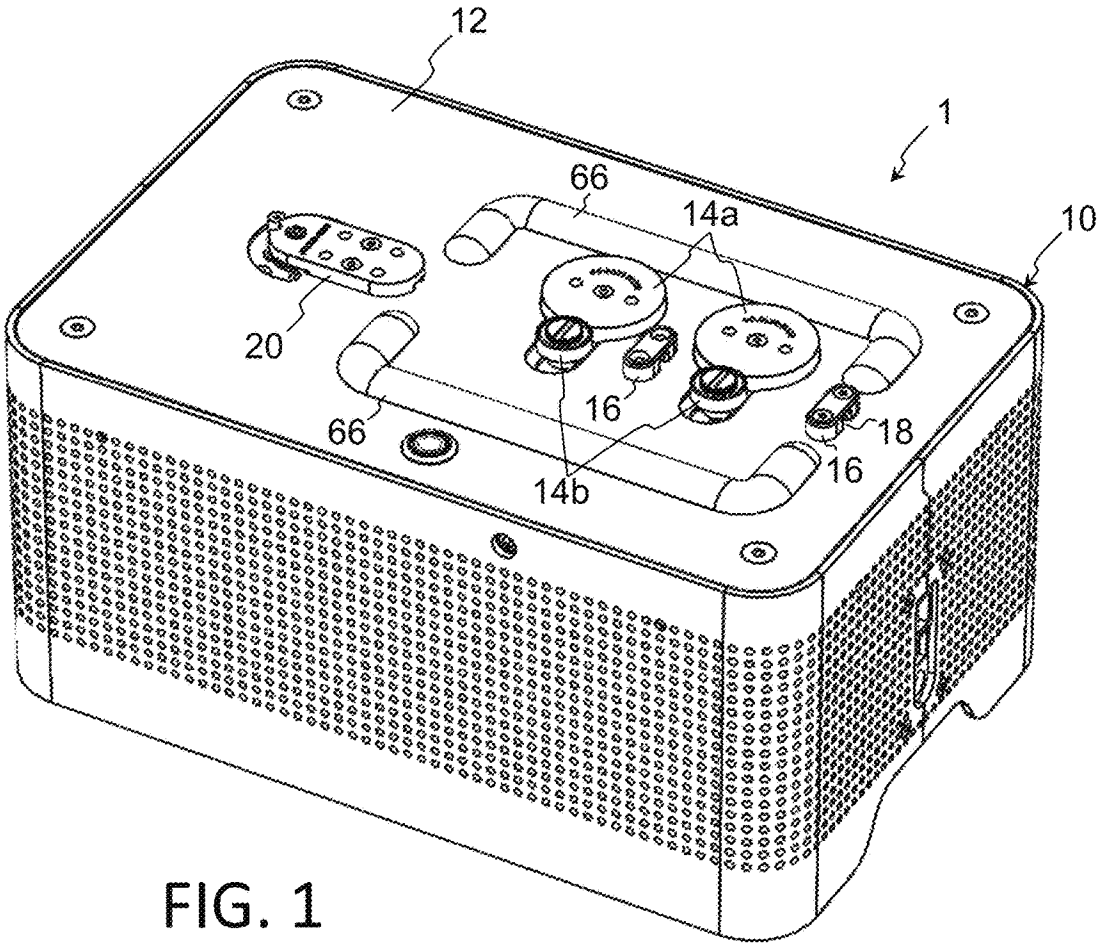
FIG. 1 is a perspective view of the wire bender.

The present invention is a desktop sized wire bender that converts drawn curves into bent wire having 2-dimensional or 3-dimensional shapes. The wire bender 1 is shown in FIG. 1, and includes a housing 10 having a top plate 12.

The top plate 12 serves as a work surface on which the wire manipulation components are positioned. These components include two pairs of feed wheels, with each pair including two wheels 14*a* and 14*b* that pinch and manipulate the wire fed therebetween. Wire guides 16 are aligned with the gap between the feed wheels 14*a* and 14*b*, and include apertures 18 through which the wire can be fed (to guide the wire in the proper direction).

Figure 2A:
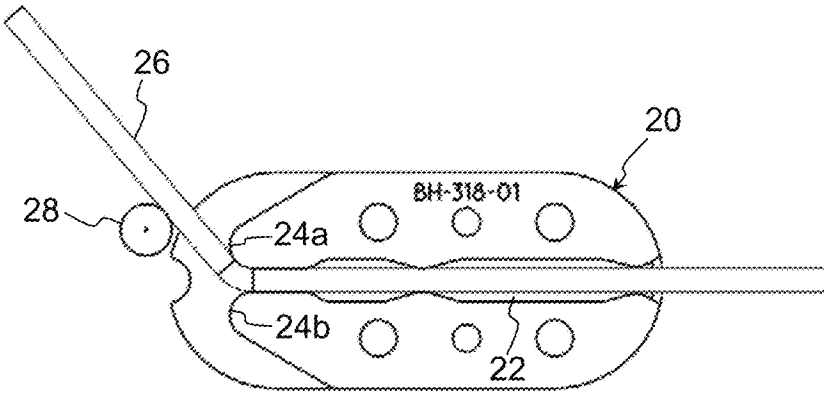
FIGS. 2A and 2B are bottom views of the bend head.
Figure 2B:
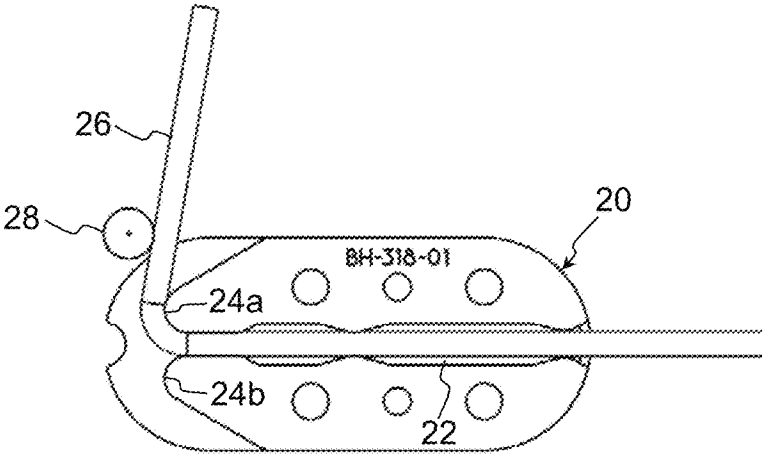

A bend head 20 is aligned with the wire guides 16. The bend head 20 is better shown in FIGS. 2A and 2B, and includes an aperture 22 through which the wire can be fed to hold the wire in place while it is being bent. Bend head 20 also includes a pair of bend surfaces 24*a* and 24*b*, one on each side of the aperture 22. As shown, a wire 26 is fed through aperture 22, and is bent around bend surface 24*a* by moving pin 28.

Figure 3:
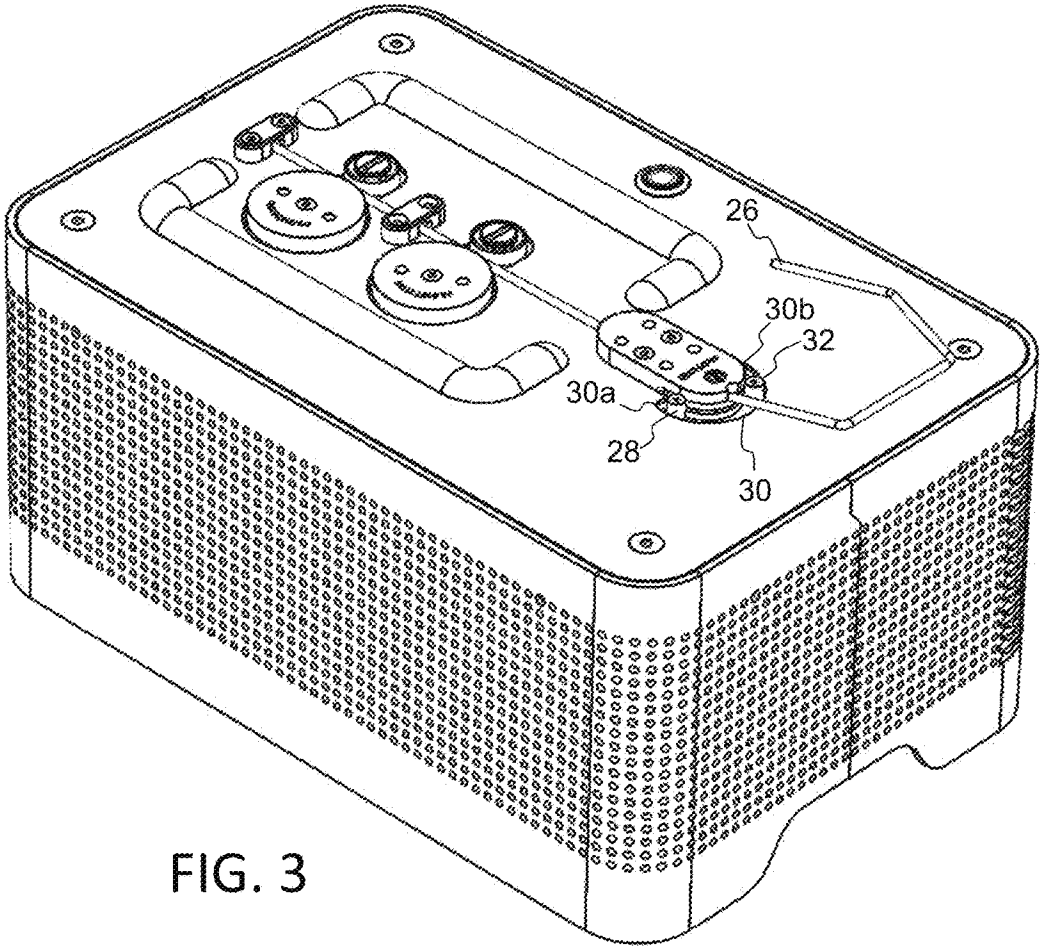
FIG. 3 is a perspective view of the wire bender.

Pin 28 travels (translates) in an arch shape path, as best shown in FIG. 3, which is dictated by arch shaped slot 30 formed in plate 12. Pin 28 protruding through slot 30. Starting at a first end 30*a* of the slot 30, the pin 28 travels along slot 30 until it engages and pushes on wire 26 (wrapping the wire around bend surface 24*a*) until the desired bend shape is achieved in the wire. At that point, pin 28 retreats partially or fully back to the first slot end 30*a*, whereby the wire is advanced to the next target location of the wire to be bent. To implement bends in the opposite direction, a second pin 32 begins at the second end 30*b* of the slot 30, and travels along slot 30 until it engages and pushes on wire 26 (wrapping the wire around bend surface 24*b*) until the desired bend shape is achieved in the wire. At that point, pin 32 retreats partially or fully back to the second slot end 30*b*. Pins 28 and 32 are a fixed distance apart in slot 30, and rotate together during operation. As pin 28 approaches the first end 30*a* of the slot, pin 28 retracts below the surface of top plate 12 so as to not interfere with the operation of second pin 32. Likewise, as pin 32 approaches the second end 30*b* of the slot, pin 32 retracts below the surface of top plate 12 so as to not interfere with the operation of first pin 28.

Figure 4A:
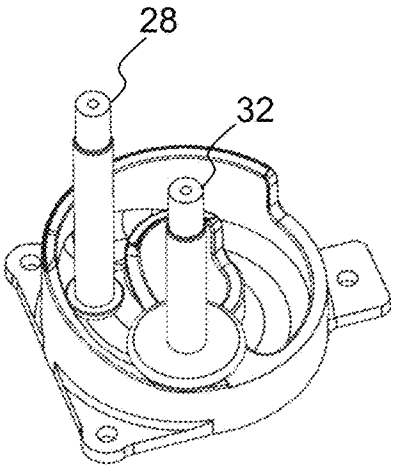
FIGS. 4A-D are perspective view of the cam member with the pins in different positions.
Figure 4B:
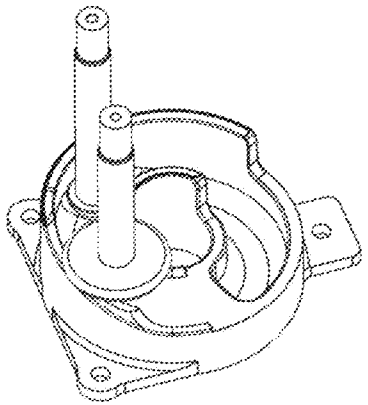
Figure 4C:
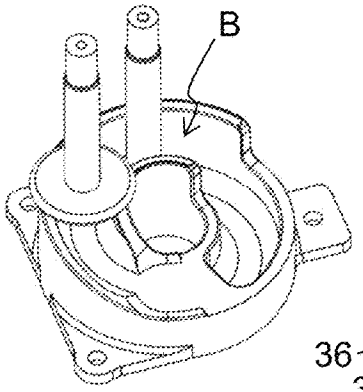
Figure 4D:
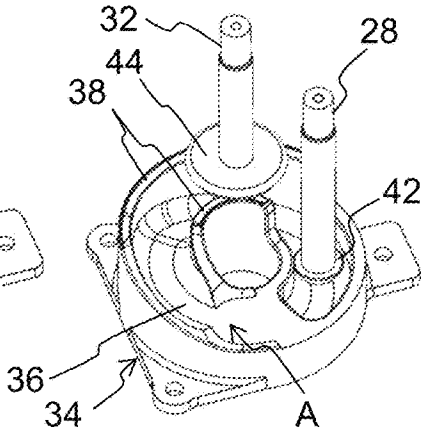
Figure 4E:
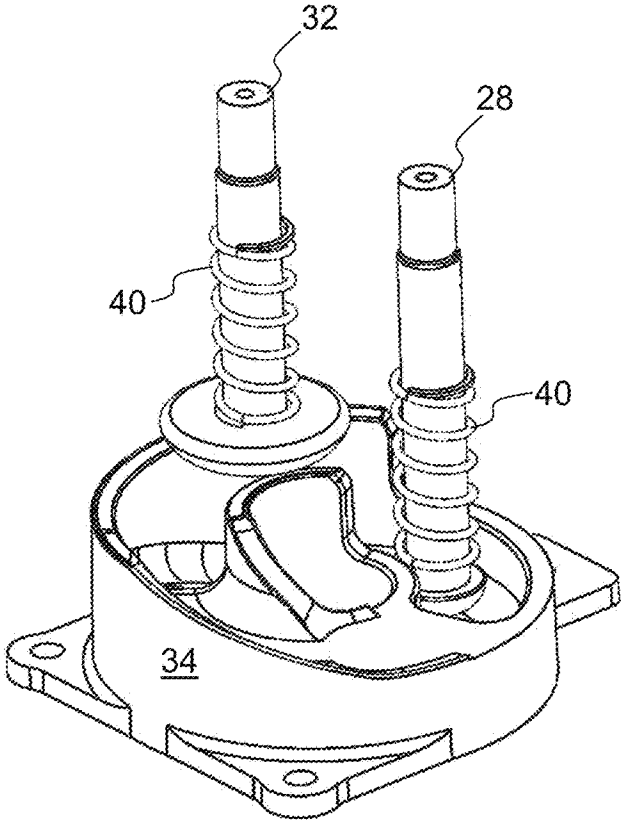
FIG. 4E is a perspective view of the springs on the pins.

FIGS. 4A-4D illustrate a cam member 34 positioned underneath plate 12 that provides two annular tracks 36 and 38 for pins 28 and 32, respectively, for controlling the vertical heights of pins 28 and 32 as they translate in their respective arc shaped paths. Track 36 includes a sloping cam surface. Track 38 includes a sloping cam surface in the form of a pair of rails that extend up from the edges of first track 36. At position A, the tracks 36 and 38 are approximately equal in vertical position. Moving clockwise from position A toward position B, the cam surface of track 36 slopes vertically down, whereas rails of track 38 slope vertically up. Pin 28 terminates in a first flange 42 that engages with and slides along first track 36. Pin 32 terminates in a second flange 44 larger than flange 42 that engages with and slides along second track 38. Both pins 28 and 32 are spring biased downwardly by springs 40 so their respective flanges 42, 44 stay engaged with their respective tracks 36, 38, as shown in FIG. 4E.

Pins 28 and 32 are spaced apart by a fixed distance, and translate in the arced path clockwise and counterclockwise together. As the pins move clockwise, pin 28 drops vertically as its flange 42 slides along the dropping track 36, while pin 32 rises vertically as its flange 44 slides along rising track 38. The opposite occurs as the pins move in the counterclockwise direction. Therefore, starting with the positioning in FIG. 4A, pin 28 is in its extended position (i.e. it extends up through slot 30 of plate 12 for engaging with wire 26), and pin 32 is in its retracted position (i.e. positioned below plate 12 and not extending up through slot 30). As the pins travel in the clockwise direction (from FIG. 4A to FIG. 4D), pin 28 drops down to its retracted position to disengage from slot 30, and pin 32 extends up to its extended position to extend up through slot 30 for engaging with wire 26. As the pins travel in the counterclockwise direction (from FIG. 4D to FIG. 4A), pin 32 drops down to its retracted position to disengage from slot 30, and pin 28 extends up to its extended position to extend up through slot 30 for engaging with wire 26. With this configuration, only a single motor is needed to translate the pins clockwise or counterclockwise along the arced path, where tracks 36 and 38 dictate the vertical height of the pins so that each pin drops below top plate 12 for large bend angles so as to not interfere with the other pin's engagement with the wire 26, and so that each pin rises up through slot 30 to engage with and bend the wire 26 as the other pin drops below plate 12 and out of the way for large bend angles in the opposite direction. Specifically, as pin 32 bends the wire 26 to the left (in FIG. 3) at a large bend angle, pin 28 will drop below plate 12, and as pin 28 bends the wire 26 to the right at a large bend angle, pin 32 drops below plate 12.

Figure 5B:
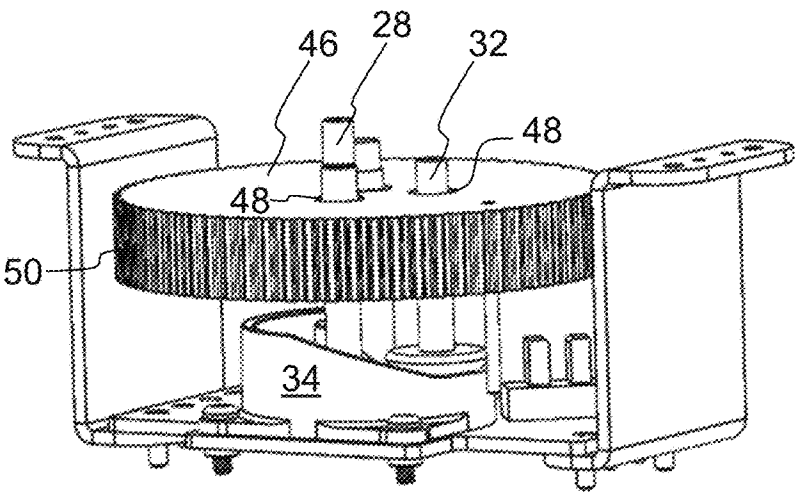
FIGS. 5A and 5B are perspective views of the timing pulley.
Figure 5A:
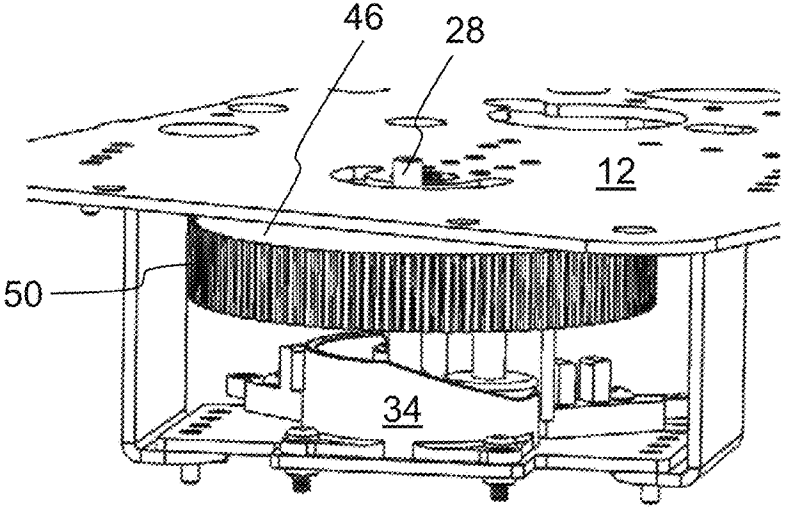
Figure 6:
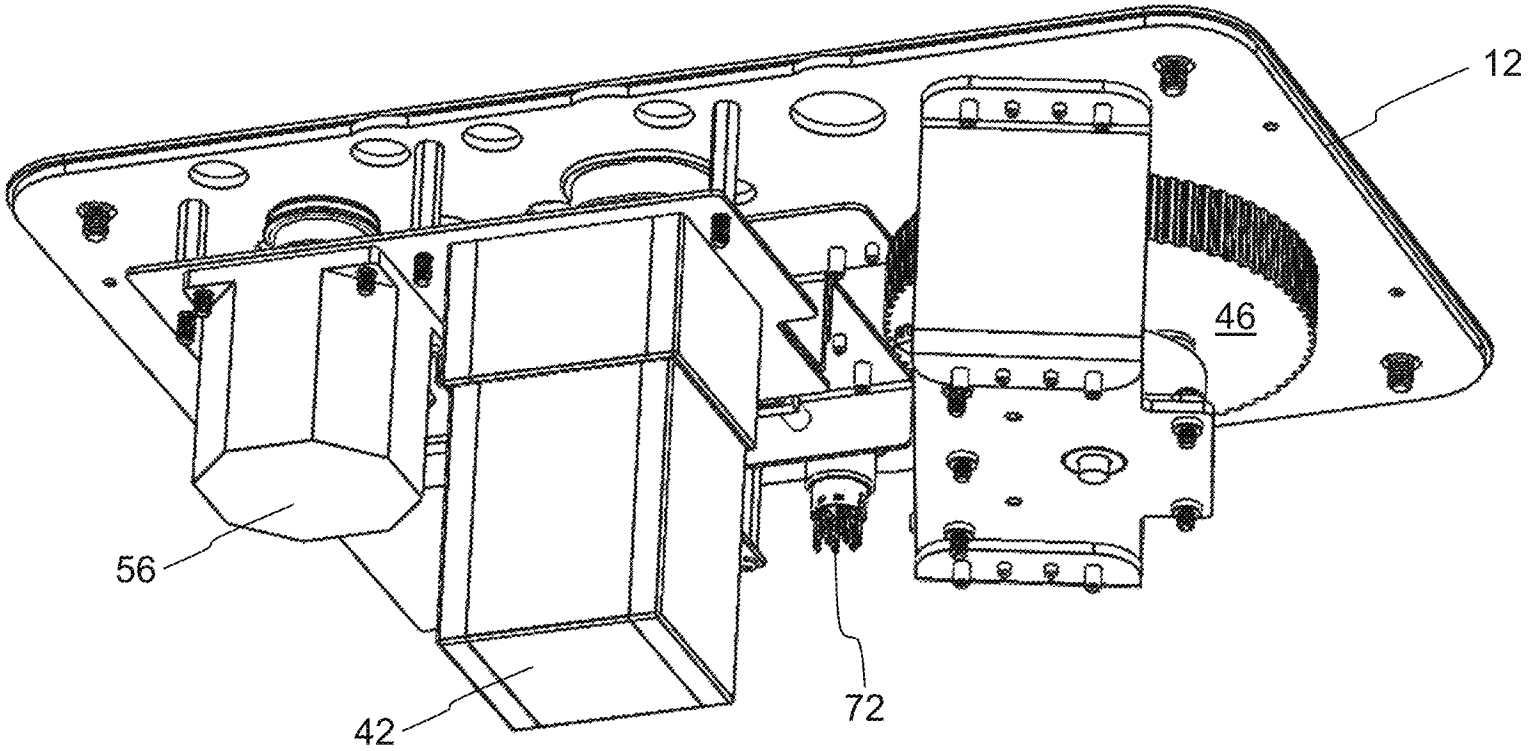
FIG. 6 is a bottom perspective view showing the components underneath the top plate.
Figure 7:
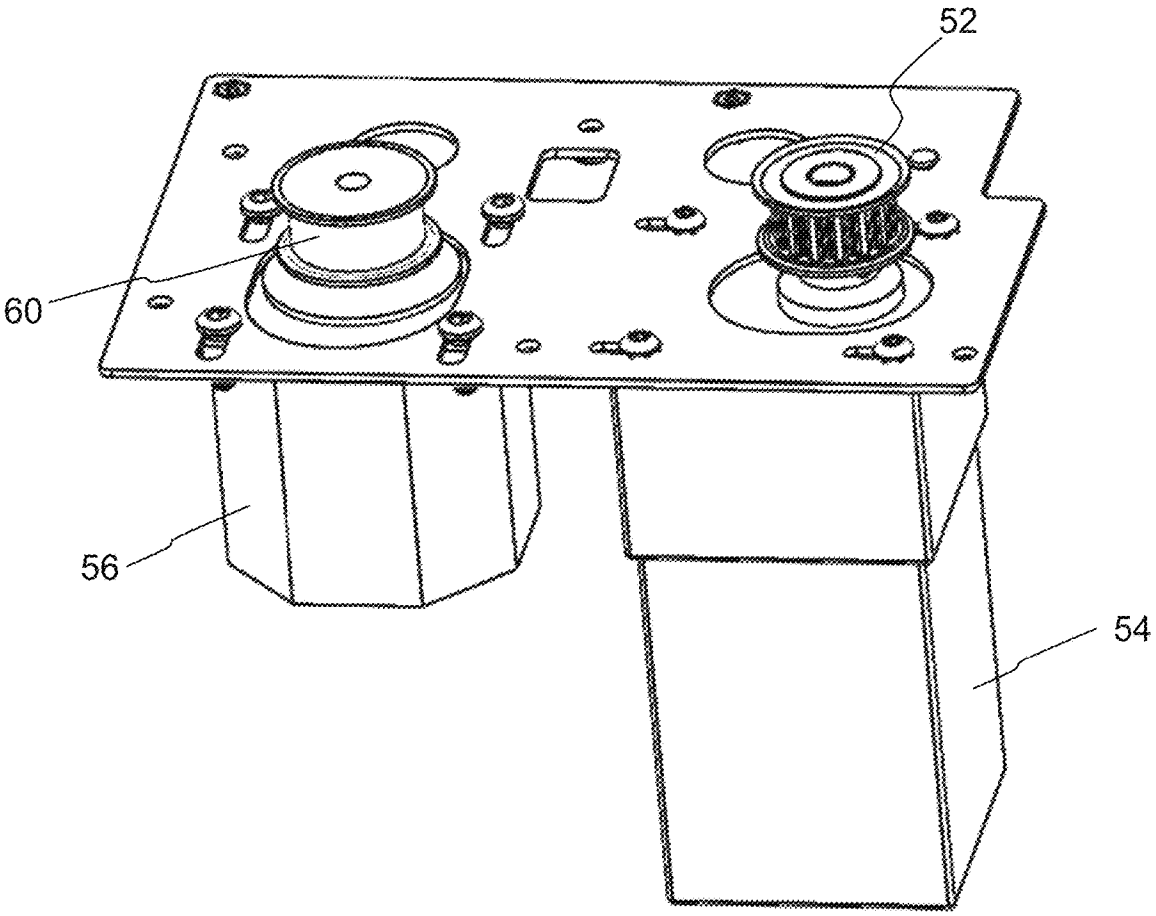
FIG. 7 is a perspective view showing the motors of the present invention.
Figure 8:
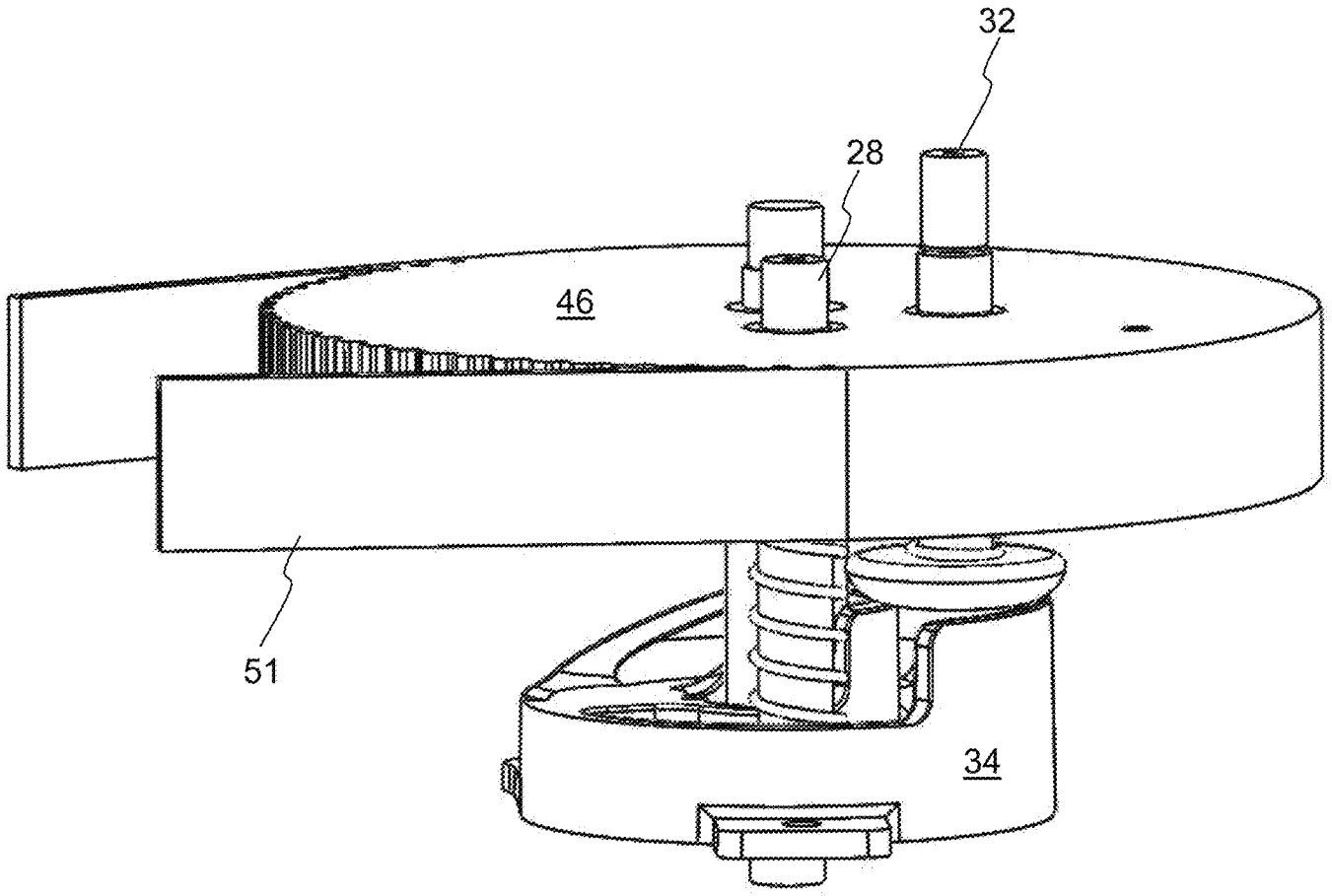
FIG. 8 is a side view showing the timing belt engaged with the pulley.

FIGS. 5A and 5B illustrate a timing pulley 46 for translating pins 28 and 32 in their arced path. Specifically, pins 28 and 32 extend through holes 48 in pulley 46. Pulley 46 includes teeth 50 that engage with a timing belt 51, which in turn engages timing pulley 52 that is rotated by bend motor 54, as shown in FIGS. 6-8. Therefore, a single motor 54 drives both the translational and vertical movement of the pins 28, 32. This configuration eliminates the need for an additional electromechanical or other means to lower and raise pins 28, 32 as they are translated.

Figure 9:
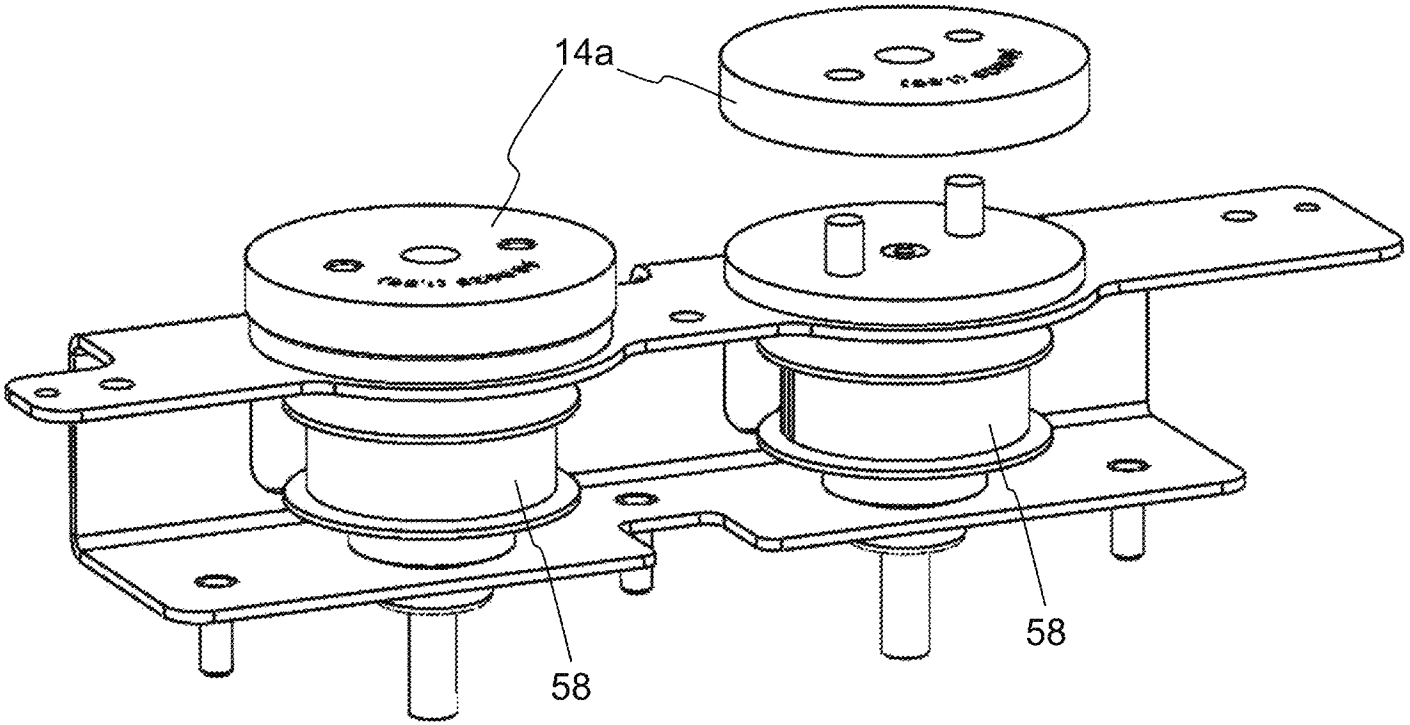
FIG. 9 is a perspective view showing the feed wheels 14*a*.

Also shown in FIGS. 6 and 7 is feed motor 56 which drives feed wheels 14*a*/14*b*. A drive belt is engaged with pulleys 58 of feed wheels 14*a* (see FIG. 9) and pulley 60 of feed motor 56 (see FIG. 7). Feed wheels 14*a*/14*b* operate synchronously because they are both driven by the same drive belt and feed motor 56. Both motors 54, 56 mount to slots 64 of the same motor plate 62 to allow the belt tensions to be adjusted. As shown in FIG. 9, the feed wheels 14A are swappable to accommodate different sizes of wire. Bend head 20 can also be swapped with one having a different size aperture to accommodate different wire sizes, and/or bend surfaces with different radii of curvature for different desired wire bend radii. Bend head 20 is preferably held in place by two screws and four pins to ensure stability as the wire is fed through. Varying bend head designs can be provided to accommodate fine wire to rod and tube, and to accommodate materials from strong steel to soft plastic.

Referring back to FIGS. 1 and 3, the top plate 12 can include ramp protrusions 66 that push the bent wire 26 up and over the other components on top plate 12 and the fed wire itself (i.e., so that bent wire 26 does not interfere with the operation of any such components and/or is caught by such components that would unintentionally further bend the bent portion of the wire.)

Figure 11:
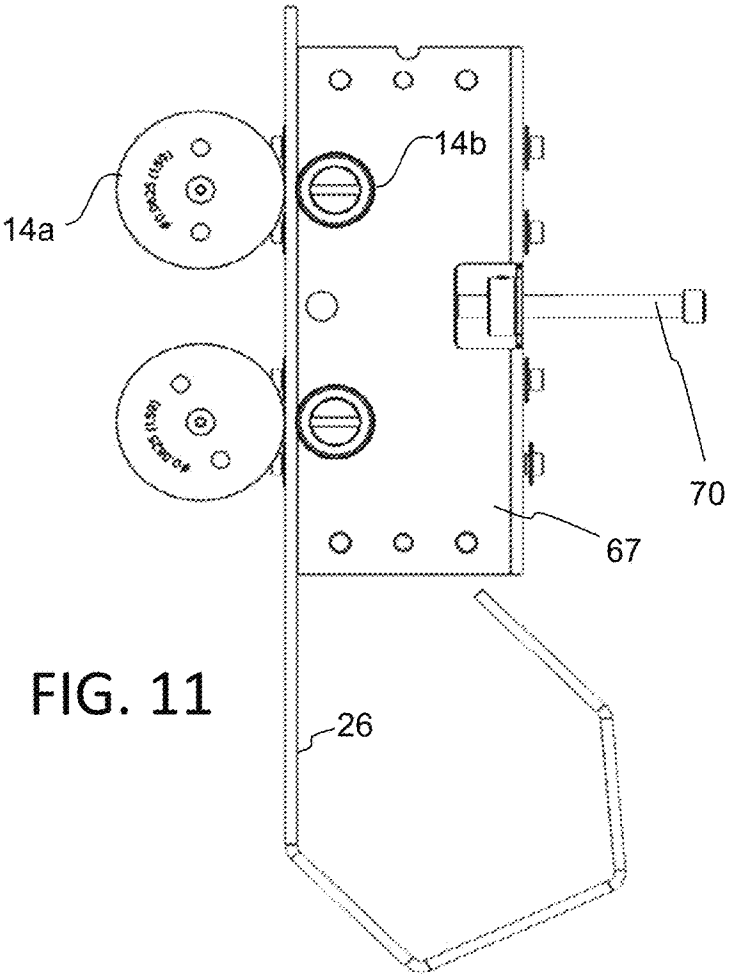
FIG. 11 is a top view of the spring loaded bearing system.
Figure 10:
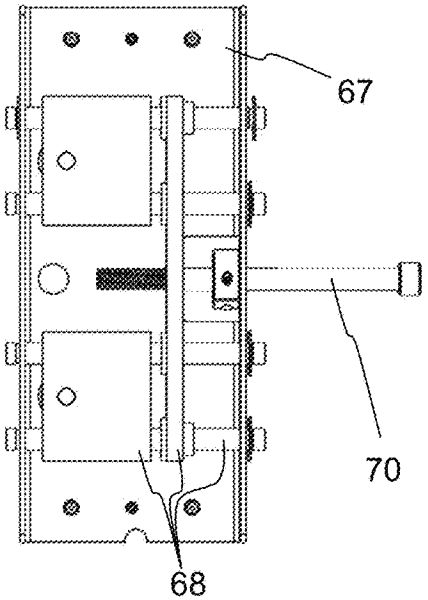
FIG. 10 is a bottom view showing the spring loaded bearing system.

Feed wheels 14*b* are preferably mounted on a spring loaded plate 67 relative to feed wheels 14*a*. As shown in FIGS. 10-11, a spring-loaded bearing system 68 is used to supply a consistent force between opposing wheels 14*a* and 14*b*. A tension adjust bolt 70 can be used to adjust the amount of force. The spring-loaded bearings and changeable feed wheels 14*a* enables accommodation of a large variety of wire sizes. The bearing system 68 and feed wheels 14*a*/14*b* keep the wire centered to prevent jams.

Figure 12:
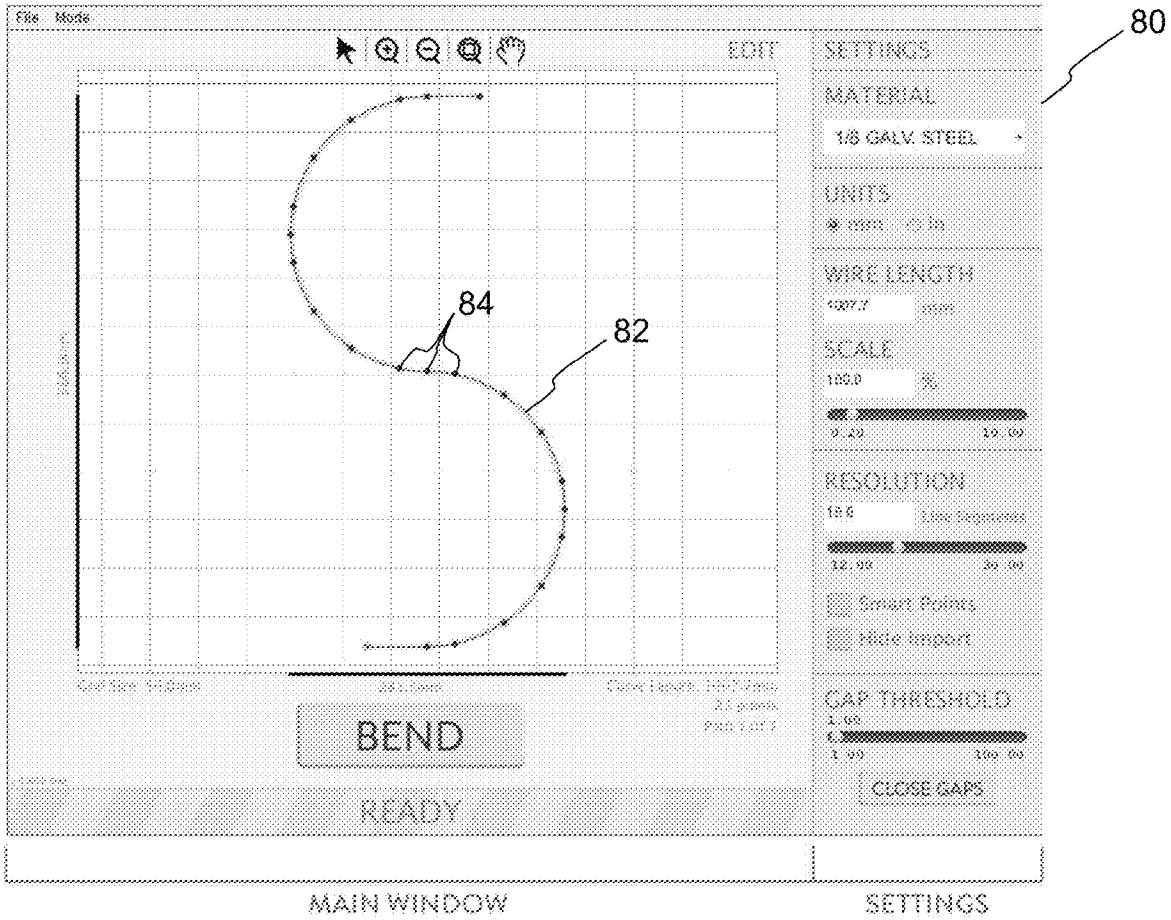
FIG. 12 is a view of an interface screen.

The wire bender 1 is preferably operated under the control of a microprocessor 72 located inside housing 10. Alternately and/or additionally, an external computer or controller can be used to control the operation of the wire bender 1. Software running on the microprocessor 72 and/or external computer or controller can provide the user the ability to control the wire bender 1 without complex coding or programming using a convenient user interface screen. An exemplary user interface screen 80 is illustrated in FIG. 12, we can be generated on a display connected to the wire bender 1, or generated on a computer connected to the wire bender 1. Screen 80 allows the user to create desired wire shapes, either drawn manually or created from user provided vector-based files such as .SVG or .DXF. Once the bend shape 82 is defined, bend points 84 are added (indicating where the wire will be bent to create shape 82). The resolution scale of the bend shape 82 can be adjusted. The bend points 84 can be moved, added or deleted by the user. The interface can indicate if any of the bend points are too close together or are at too sharp an angle. The interface can also allow the user to select the wire material, the units, the wire length, the scale and resolution of the displayed shape, a smart point mode in which straight line segments are automatically recognized and the bend points are evenly distributed across the curves, and a gap threshold under which the interface will automatically close any gaps.

Figure 13:
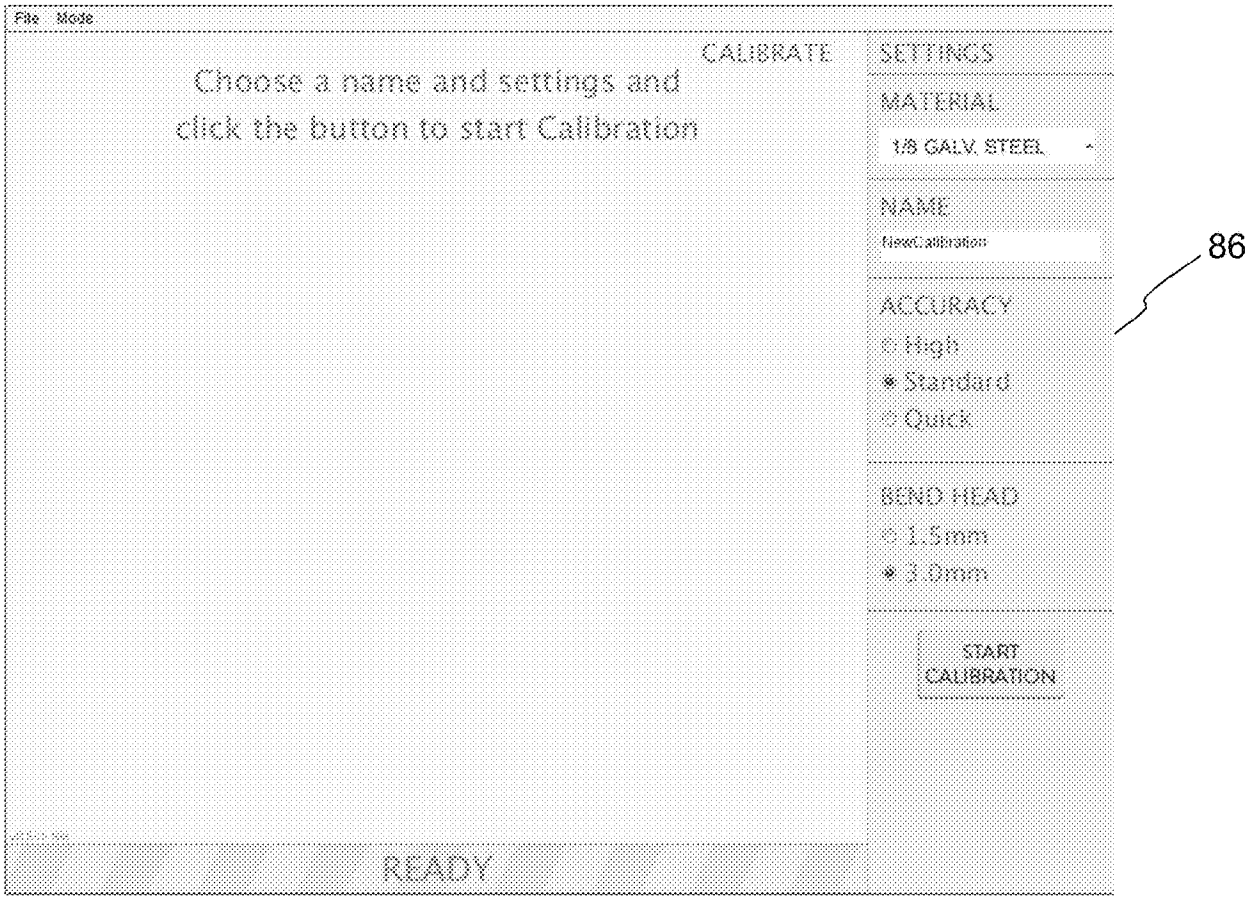
FIG. 13 is a view of a calibration screen.
Figure 14:
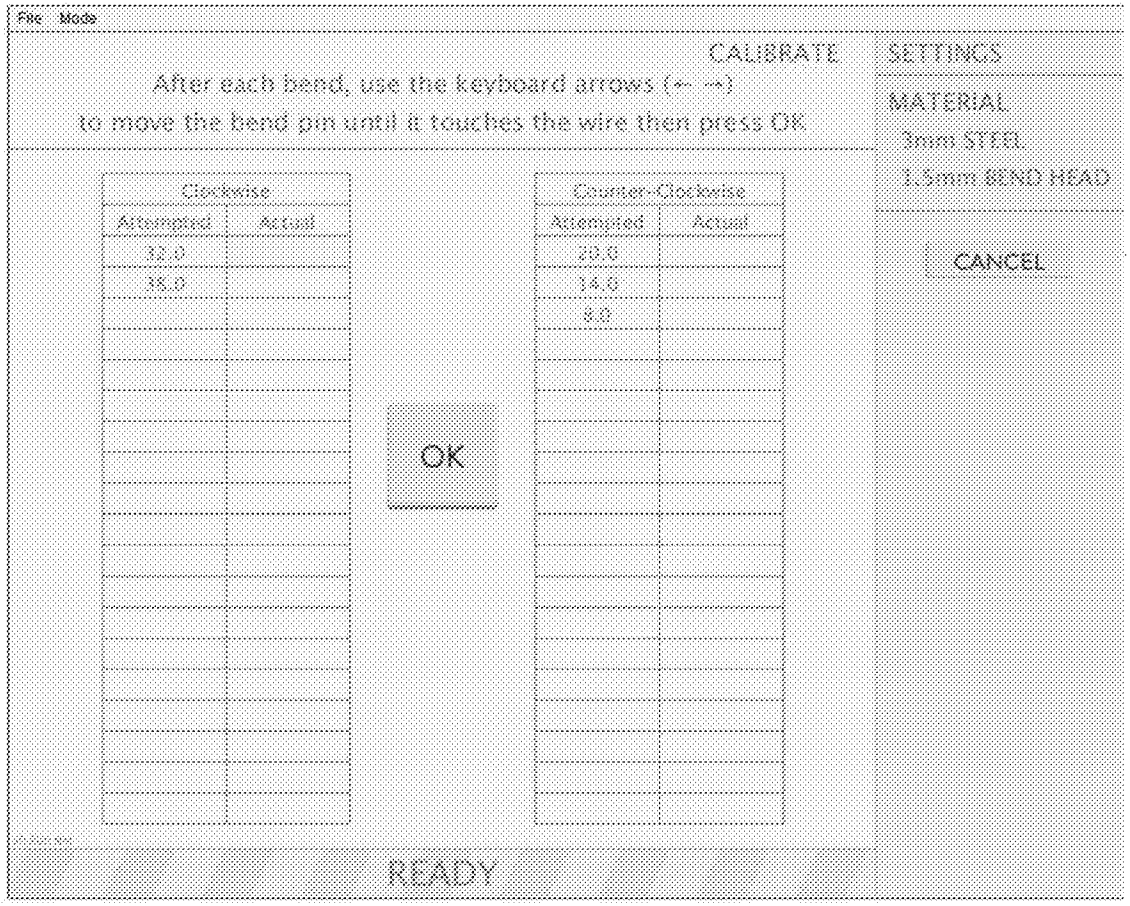
FIG. 14 is a view of a calibration screen.

The interface includes a calibration screen 86 (see FIG. 13) that compensates for springback, which is slight movement in the reverse direction by the wire after a bend is created. To implement the desired bend in most wires, the wire is slightly over-bent so that after springback, the wire is left with the desired amount of bend. Wires of different materials and/or diameters will exhibit different springback characteristics. The calibration screen allows the user to calibrate the amount of over-bending compensation for the given wire being used. After the user inputs the wire material, accuracy level (high accuracy takes longer and uses more wire), and bend head being used, the wire bender begins calibration. Calibration involves implementing a bend in the wire, and then having the user manually position the pin so that is just touches the wire (whereby the pin position indicates to the device the actual bend of the wire after springback). This is performed several times for both directions, as illustrated in FIG. 14. The column titled "Actual" will populate with the actual angles to which the wire has been bent as determined through calibration. Through this process, the wire bender 1 will determine an overbend correction factor which will dictate how much over-bend compensation will be used at the various angles given the actual wire being used and comparisons between attempted and actual wire bends performed by the calibration. Subsequent wire bending is then performed by overbending the wire based upon the overbend correction factor.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims.

Hardware, software and/or firmware can be used to implement any of the logic steps and/or processes discussed above. It should further be appreciated that such logic steps or processes can be implemented as computer-executable instructions stored on a non-transitory computer readable medium, such a CD or DVD (including re-writable CDs and DVDs), flash or other non-volatile memory, ROM, EEPROM, disc drive, solid state drive, etc. When the program code is loaded into and executed by a machine, such as a computer or dedicated processer, the machine becomes an apparatus for practicing the invention. The present invention can also be embodied in the form of program code, for example, whether stored in a storage medium, loaded into and/or executed by a machine, or transmitted over some transmission medium, such as over electrical wiring or cabling, through fiber optics, or via electromagnetic radiation, wherein, when the program code is loaded into and executed by a machine, such as a computer or processor, the machine becomes an apparatus for practicing the invention. When implemented on a general-purpose processor, the program code segments combine with the processor to provide a unique device that operates analogously to specific logic circuits.

It should be noted that, as used herein, the terms "over" and "on" both inclusively include "directly on" (no intermediate materials, elements or space disposed therebetween) and "indirectly on" (intermediate materials, elements or space disposed therebetween). Likewise, the term "adjacent" includes "directly adjacent" (no intermediate materials, elements or space disposed therebetween) and "indirectly adjacent" (intermediate materials, elements or space disposed there between), "mounted to" includes "directly mounted to" (no intermediate materials, elements or space disposed there between) and "indirectly mounted to" (intermediate materials, elements or spaced disposed there between), and "electrically coupled" includes "directly electrically coupled to" (no intermediate materials or elements there between that electrically connect the elements together) and "indirectly electrically coupled to" (intermediate materials or elements there between that electrically connect the elements together). For example, forming an element "over a substrate" can include forming the element directly on the substrate with no intermediate materials/elements therebetween, as well as forming the element indirectly on the substrate with one or more intermediate materials/elements therebetween.

What is claimed is:

1. A device for bending wire, comprising:

a housing have a top plate, wherein the top plate includes a curved slot;

a first pair of opposing wheels positioned over the top plate for feeding wire;

a bend head that includes:

an aperture configured to pass the wire fed from the first pair of opposing wheels, and first and second bend surfaces positioned adjacent to the curved slot and the aperture;

a cam member disposed below the top plate, wherein the cam member includes:

a first vertically sloping cam surface, and a second vertically sloping cam surface;

a rotatable pulley disposed between the cam member and the top plate, and comprising first and second holes;

a first pin having a first end slidably engaged with the first cam surface, a middle portion extending through the first hole, and a second end;

a second pin having a first end slidably engaged with the second cam surface, a middle portion extending through the second hole, and a second end;

a motor for rotating the pulley in opposing first and second rotational directions;

wherein the pulley rotating in the first rotational direction causes the first pin first end to slide along the first cam surface so that the first pin second end rises vertically through the curved slot and then travels along the curved slot for engaging with and bending the wire passing through the aperture against the first bend surface; and wherein the pulley rotating in the second rotational direction causes the second pin first end to slide along the second cam surface so that second pin second end rises vertically through the curved slot and then travels along the curved slot for engaging with and bending the wire passing through the aperture against the second bend surface.

2. The device of claim 1, wherein:

the pulley rotating in the first rotational direction causes the second pin first end to slide along the second cam surface so that the second pin second end travels along the curved slot and then drops vertically from the curved slot; and the pulley rotating in the second rotational direction causes the first pin first end to slide along the first cam surface so that the first pin second end travels along the curved slot and then drops vertically from the curved slot.

3. The device of claim 1, further comprising:

a first spring engaged between the pulley and the first pin to bias the first pin first end onto the first cam surface; and a second spring engaged between the pulley and the second pin to bias the second pin first end onto the second cam surface.

4. The device of claim 1, wherein the first cam surface slopes vertically down in the first rotational direction; and the second cam surface comprises a pair of rails that extend up from edges of the first cam surface, the pair of rails slope vertically up in the first rotational direction.

5. The device of claim 4, wherein the first pin first end includes a first flange that engages with the first cam surface, and wherein the second pin first end includes a second flange, larger than the first flange, that engages with the rails.

6. The device of claim 1, further comprising:

a second motor for rotating at least one of the first pair of opposing wheels.

7. The device of claim 1, further comprising:

a second pair of opposing wheels positioned over the top plate for feeding the wire to the first pair of opposing wheels.

8. The device of claim 7, further comprising:

a second motor for rotating at least one of the first pair of opposing wheels and at least one of the second pair of opposing wheels.

9. The device of claim 7, further comprising:

a wire guide having an aperture for guiding the wire from the second pair of opposing wheels to the first pair of opposing wheels.

10. The device of claim 6, further comprising:

a processor for controlling the first and second motors.

11. The device of claim 10, wherein the processor is configured with a calibration mode in which the processor causes one of the first and second pins to bend the wire, then prompts a user to manually position the one pin to touch the bent wire, determines an over-bend correction factor based on the manual position of the one pin, and causing subsequent wire bending using the over-bend correction factor.

12. A device for bending wire, comprising:

a housing have a top plate, wherein the top plate includes a curved slot;

one or more ramp protrusions on the top plate;

a first pair of opposing wheels positioned over the top plate for feeding wire;

a bend head that includes:

an aperture configured to pass the wire fed from the first pair of opposing wheels, and first and second bend surfaces positioned adjacent to the curved slot and the aperture;

a cam member disposed below the top plate, wherein the cam member includes:

a first vertically sloping cam surface, and a second vertically sloping cam surface;

a rotatable pulley disposed between the cam member and the top plate, and comprising first and second holes;

a first pin having a first end slidably engaged with the first cam surface, a middle portion extending through the first hole, and a second end;

a second pin having a first end slidably engaged with the second cam surface, a middle portion extending through the second hole, and a second end;

a motor for rotating the pulley in opposing first and second rotational directions;

wherein the pulley rotating in the first rotational direction causes the first pin first end to slide along the first cam surface so that the first pin second end rises vertically through the curved slot and then travels along the curved slot for engaging with and bending the wire passing through the aperture against the first bend surface; and wherein the pulley rotating in the second rotational direction causes the second pin first end to slide along the second cam surface so that second pin second end rises vertically through the curved slot and then travels along the curved slot for engaging with and bending the wire passing through the aperture against the second bend surface.

* * * * *